US010694867B2

(12) United States Patent
Troutman et al.

(10) Patent No.: US 10,694,867 B2
(45) Date of Patent: Jun. 30, 2020

(54) INFANT CARRIER

(71) Applicant: Kolcraft Enterprises, Inc., Chicago, IL (US)

(72) Inventors: Hyon Troutman, Northbrook, IL (US); Sarah Green, Chicago, IL (US); Gabrielle Fraire, Chicago, IL (US); Shannen Root Chin, Chicago, IL (US)

(73) Assignee: KOLCRAFT ENTERPRISES, INC., Chicago, IL (US)

( * ) Notice: Subject to any disclaimer, the term of this patent is extended or adjusted under 35 U.S.C. 154(b) by 0 days.

(21) Appl. No.: 16/358,405

(22) Filed: Mar. 19, 2019

(65) Prior Publication Data

US 2019/0281995 A1 Sep. 19, 2019

Related U.S. Application Data

(60) Provisional application No. 62/644,883, filed on Mar. 19, 2018.

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02
See application file for complete search history.

(56) References Cited

U.S. PATENT DOCUMENTS 4,333,591 A 6/1982 Case
4,923,104 A 5/1990 Rice
5,490,620 A 2/1996 Bergqvist
5,609,279 A * 3/1997 O'Shea ..... A47D 13/025 224/155
5,732,861 A 3/1998 Jakobson
5,848,741 A * 12/1998 Fair ..... A47C 7/66 224/160
5,934,529 A 8/1999 Obrien
D414,032 S 9/1999 Howell
6,283,347 B1 9/2001 Roh
D453,066 S 1/2002 Norman
(Continued)

FOREIGN PATENT DOCUMENTS

DE 202012006709 8/2012
JP 2015131024 A 7/2015
WO 2016020707 A1 2/2016

OTHER PUBLICATIONS

ByKay Instruction / Mei Tai Front, retrieved from the Internet on Feb. 5, 2019; URL https://www.youtube.com/watch?v=TczmbwJrn9c; Jul. 6, 2017.

(Continued)

*Primary Examiner* — Corey N Skurdal
(74) *Attorney, Agent, or Firm* — Lempia Summerfield Katz LLC

(57) ABSTRACT

An infant carrier includes a main panel configured to support an infant between the main panel and a caregiver, first and second shoulder straps each having one end extending from the main panel and another end detachably connectable to a portion of the infant carrier, and a waist band disposed at a lower end of the main panel. A shade is attached to and selectively detachable from the infant carrier. The shade is deployable to cover and extend above at least a top portion of the main panel.

17 Claims, 9 Drawing Sheets

(56) References Cited

U.S. PATENT DOCUMENTS

| | | | | |
|---|---|---|---|---|
| D455,546 | S | 4/2002 | Norman | |
| 6,598,771 | B2 | 7/2003 | Norman | |
| 6,763,983 | B2 | 7/2004 | Norman | |
| D507,102 | S | 7/2005 | Bergkvist | |
| 6,988,644 | B1 | 1/2006 | Asherbranner | |
| 7,252,214 | B2 | 8/2007 | Krogh | |
| 7,322,498 | B2 | 1/2008 | Frost | |
| 7,343,880 | B2 | 3/2008 | Bergkvist | |
| D567,499 | S | 4/2008 | Elmberg | |
| 7,661,566 | B2 | 2/2010 | Yoshie | |
| D611,699 | S | 3/2010 | Lundh | |
| D623,401 | S | 9/2010 | Bergkvist | |
| D642,375 | S | 8/2011 | Zack | |
| D649,345 | S | 11/2011 | Bergkvist | |
| D655,495 | S | 3/2012 | Sauer | |
| D664,351 | S | 7/2012 | Bergkvist | |
| 8,393,505 | B2 | 3/2013 | Coote | |
| 8,490,844 | B2 | 7/2013 | Favorito | |
| 8,579,168 | B2 | 11/2013 | Zack | |
| 8,590,757 | B2 | 11/2013 | Frost | |
| 8,627,988 | B2 | 1/2014 | Bergkvist | |
| 8,973,794 | B2 | 3/2015 | Bergkvist | |
| 9,022,260 | B2 | 5/2015 | Frost | |
| 9,038,868 | B2 | 5/2015 | Poiani | |
| 9,085,930 | B2 | 7/2015 | Steiner | |
| 9,185,993 | B2 | 11/2015 | Telford | |
| 9,314,111 | B2 | 4/2016 | Hartwell | |
| 9,357,852 | B2 | 6/2016 | Salazar | |
| 9,380,887 | B2 | 7/2016 | Frost | |
| 9,380,888 | B2 | 7/2016 | Telford | |
| 9,386,863 | B1 | 7/2016 | Antunovic | |
| 9,439,516 | B2 | 9/2016 | Workman | |
| 9,713,391 | B2 | 7/2017 | Telford | |
| 9,788,664 | B2 | 10/2017 | Andren | |
| 9,955,797 | B2 | 5/2018 | Telford | |
| 10,159,357 | B2 | 12/2018 | Frost | |
| 2005/0045675 | A1* | 3/2005 | Redlinger | A47D 13/025 224/161 |
| 2005/0279785 | A1 | 12/2005 | Liistro | |
| 2006/0261104 | A1 | 11/2006 | Zambrzycki | |
| 2008/0283559 | A1 | 11/2008 | Parness | |
| 2010/0096419 | A1 | 4/2010 | Stephens | |
| 2010/0147910 | A1 | 6/2010 | Schachtner | |
| 2010/0155446 | A1 | 6/2010 | Stein | |
| 2011/0101051 | A1 | 5/2011 | Parness | |
| 2012/0241487 | A1* | 9/2012 | Zack | A47D 13/025 224/576 |
| 2013/0292973 | A1 | 11/2013 | Loaiza | |
| 2014/0014692 | A1 | 1/2014 | Andren | |
| 2014/0021751 | A1 | 1/2014 | Lang | |
| 2014/0027478 | A1 | 1/2014 | Lifshitz | |
| 2014/0069968 | A1 | 3/2014 | Frost | |
| 2014/0097215 | A1 | 4/2014 | Caperon | |
| 2014/0307310 | A1 | 10/2014 | Steiner | |
| 2014/0319189 | A1 | 10/2014 | Hoppener-visser | |
| 2016/0278537 | A1 | 9/2016 | Frost | |
| 2017/0251829 | A1 | 9/2017 | Telford | |

OTHER PUBLICATIONS

How Do I Use The Omni 360 Baby Carrier / Ergobaby, retrieved from Internet on Feb. 5, 2019; URL https://www.youtube.com/watch?v=2OwWaQtvOTM; Aug. 7, 2017.

ISR 06262019, International Search Report cited in the corresponding International app No. PCT/US19/22990; dated Jun. 26, 2019; 2 pp.

Written Opinion of the International Searching Authority cited in the corresponding International app No. PCT/US19/22990; dated Jun. 26, 2019; 8 pp.

* cited by examiner

INFANT CARRIER

RELATED APPLICATION DATA

This patent is related to and claims priority benefit of U.S. Provisional Application Ser. No. 62/644,883 filed Mar. 19, 2018 and entitled "Infant Carrier with Removable Hood or Cover." The entire contents of this prior filed application are hereby incorporated herein by reference.

BACKGROUND

1. Field of the Disclosure

The present disclosure is generally directed to soft infant carriers, and more particularly to an infant carrier with adjustment features to accommodate a range of sizes for both children being carried and caregivers wearing the carrier.

2. Description of Related Art

Soft infant carriers are known in the art. Such infant carriers are worn on the body of a caregiver and allow a caregiver to carry an infant while leaving the caregiver's hands free. Some infant carriers are reversible in that the carrier can be worn on either the chest side or back of a caregiver. Some infant carriers include a sun shade, hood, or protective cover feature, i.e., a shade feature. Most infant carriers are designed, at least in some manner, to accommodate a range of caregiver sizes. Challenges in design and implementation, and problems during use, have been noted and attempts have been made to address these challenges and problems.

For example, user frustration may occur with existing shades because the shades do not accommodate a wide range of infant sizes and/or infant growth. Existing shades may be too small or too large for a child being carried in the carrier. Sometimes, the shade may get in the way and impede use of either the shade or the infant carrier, once the child no longer uses or needs the shade. Sometimes, when not in use, the shade might be stored in a storage pocket and limit the ability to store other items in the pocket. Sometimes, when not in use, the shade might be left hanging down completely when not stored in the pocket and, because of its length, can interfere with the caregiver while walking, sitting, maneuvering, or the like.

Others have provided infant carriers with shades that have these issues. For example, ERGO BABY, including the Ergo 360, Adapt, and Original products, LILLE BABY, including the Complete, Essentials, and CarryOn products, and INFANTINO, including the Sash and All-Season products, provide infant carriers with shades that are permanently attached along webbing of the carriers. INFANTINO, including the Go Forward product, provides an infant carrier with a detachable shade with a four-point attachment.

Some infant carriers include a height adjustable cross-strap between the shoulder straps of the carrier. The cross-strap is not easily reachable by the caregiver around their back when the carrier is worn in the front carry position or mode. It is thus difficult or impossible for the caregiver to adjust the height of the cross-strap on their own. Instead, the caregiver may need to elicit the help of another person to adjust the height of the cross-strap when the infant carrier is being worn. Alternatively, the caregiver may instead choose to wear the infant carrier in a different mode, such as with crisscrosses shoulder straps instead of straight backpack style, or they may choose to pre-buckle the cross-strap and then set the position before putting the carrier over their head. This can make mounting the carrier more difficult and result in the carrier being adjusted in a way that is not ideal for the caregiver. It is not apparent that others have tried to address this issue.

Many infant carriers offer an adjustable waist band or belt configuration. However, many of these products provide a waist band that is either too short to accommodate individuals with larger waist sizes or too long to accommodate individuals with smaller waist sizes. Sometimes, excess length in the waist band or in the adjustments straps hangs down in a manner such that the excess portions get in the way of the caregiver during use.

Others have provided carriers with shorter padded sections on the waist band to accommodate individuals with smaller waist sizes. This reduces the comfort for medium and large waists. More specifically, the unpadded adjustment straps bear directly against the body of the caregiver where no padded portion of the waist band is present. This can cause chaffing and discomfort for the caregiver.

SUMMARY

In one example, according to the teachings of the present disclosure, an infant carrier includes a main panel configured to support an infant between the main panel and a caregiver, first and second shoulder straps each having one end extending from the main panel and another end detachably connectable to a portion of the infant carrier, and a waist band disposed at a lower end of the main panel. The infant carrier has a shade attached to and selectively detachable from the infant carrier, the shade being deployable to cover and extend above at least a top portion of the main panel.

In one example, the infant carrier can include a pocket on the main panel. The shade can be storable or stowable in the pocket and can be deployable from the pocket.

In one example, the shade can have a panel with side edges. Each side edge can be retained on a respective webbing such that the panel is slidable along the webbings to adjust a height of the panel on the infant carrier.

In one example, the shade can include a panel having side edges. Each side edge can include a sleeve with a webbing is threaded through each of the sleeves.

In one example, the shade can be retained on spaced apart webbings. The webbings can each be removable from and attachable to the main panel, the first and second shoulder straps, and/or both.

In one example, the shade can be retained on spaced apart webbings. The webbings can each have an exposed lower end with a snap that is engageable with a corresponding snap carried on the main panel.

In one example, the infant carrier can include a pocket on the main panel. The shade can be storable or stowable in the pocket and deployable from the pocket. At least two tabs can be carried on the main panel. One tab can be disposed near each opposed side of the pocket and within the pocket. The shade can be snapped to snaps carried on the tabs.

In one example, the shade can be retained on spaced apart webbings. The webbings can each have an exposed upper end with a snap on the upper end that is engageable with a corresponding snap carried on each of the shoulder straps, respectively, when deployed.

In one example, each shoulder strap can have at least two corresponding snaps carried thereon. The shade can be retained on spaced apart webbings and each webbing can include a snap on the upper end of the respective webbing.

The snaps can be selectively connectable to either of the at least two corresponding snaps on the respective shoulder strap.

In one example, the shade can be retained on spaced apart webbings. The webbings can each have a second snap on the lower end of the webbing. Each second snap can be connectable to a first snap on the respective lower end to deploy the shade in a folded hanging position outside of a shade storage pocket on the main panel.

In one example, the infant carrier can be configured to be selectively worn on at least a chest side of a caregiver and on a back of the caregiver.

In one example, the infant carrier can include a cross-strap extending between and slidable along the first and second shoulder straps such that the cross-strap is height adjustable.

In one example, the infant carrier can include a cross-strap between the shoulder straps. The cross-strap can have a first strap section carried on the first shoulder strap and a second strap section carried on the second shoulder strap. The first and second strap sections can be connectable to and detachable from one another. A length of the cross-strap between the shoulder straps can also be adjustable.

In one example, the infant carrier can include a cross-strap between the shoulder straps. The cross-strap can have a first strap section with a ring portion circumventing the first shoulder strap and has a second strap section with a ring portion circumventing the second shoulder strap.

In one example, the infant carrier can include a cross-strap between the shoulder straps. The cross-strap can include one or more finger loops extending therefrom. The one or more finger loops can be configured to be grasped by a caregiver to adjust the height of the cross-strap.

In one example, the infant carrier can include a cross-strap between the shoulder straps. The cross-strap can include a first finger loop that extends from a first strap section and a second finger loop that extends from a second strap section of the cross-strap. Each of the first and second finger loops can be configured to receive a finger or a thumb of a caregiver.

In one example, the waist band can include a first end section extending outward relative to one side edge of the main panel, a second end section extending outward relative to another side edge of the main panel opposite the one side edge, and a waist buckle having a first connector and a second connector. The first connector can be fixed to the second end section spaced from a free end thereof. The waist band can include an adjustment strap fixed to the first end section at a fixing location spaced from a free end thereof. The second connector can be adjustably carried on the adjustment strap. The waist band can include a first guide band carried on the second end section between the free end thereof and the first connector, and a second guide band and a third guide band carried on the first end section between the free end thereof and the fixing location of the adjustment strap. The second guide band can be positioned closer to the free end and the third guide band positioned closer to the fixing location. The second connector of the waist buckle can be threaded through only the first guide band and connected to the first connector in a small waist arrangement of the waist band. The second connector of the waist buckle can be threaded through the third and the first guide bands and connected to the first connector in a mid-sized waist arrangement of the waist band. The second connector of the waist buckle can be threaded through the third, second, and first guide bands and connected to the first connector in a large waist arrangement of the waist band.

In one example according to the teachings of the present disclosure, an infant carrier includes a main panel configured to support an infant between the main panel and a caregiver, first and second shoulder straps each having one end extending from the main panel and another end detachably connectable to a portion of the infant carrier, and a waist band disposed at a lower end of the main panel. The infant carrier includes a cross-strap extending between and slidable along the first and second shoulder straps such that the cross-strap is height adjustable. At least one finger loop extends from a portion of the cross-strap. The at least one finger loop is configured to be grasped by a caregiver to adjust the height of the cross-strap.

In one example according to the teachings of the present disclosure, an infant carrier includes a main panel configured to support an infant between the main panel and a caregiver, first and second shoulder straps each having one end extending from the main panel and another end detachably connectable to a portion of the infant carrier, and a waist band disposed at a lower end of the main panel. The waist band includes a first end section extending outward relative to one side edge of the main panel, a second end section extending outward relative to another side edge of the main panel opposite the one side edge, and a waist buckle having a first connector and a second connector. The first connector is fixed to the second end section spaced from a free end thereof. An adjustment strap is fixed to the first end section at a fixing location spaced from a free end thereof. The second connector is adjustably carried on the adjustment strap. A first guide band is carried on the second end section between the free end thereof and the first connector. A second guide band and a third guide band are carried on the first end section between the free end thereof and the fixing location of the adjustment strap. The second guide band is positioned closer to the free end and the third guide band positioned closer to the fixing location. The second connector of the waist buckle is threaded through only the first guide band and connected to the first connector in a small waist arrangement of the waist band. The second connector of the waist buckle is threaded through the third and the first guide bands and connected to the first connector in a mid-sized waist arrangement of the waist band. The second connector of the waist buckle is threaded through the third, second, and first guide bands and connected to the first connector in a large waist arrangement of the waist band.

In other examples according to the teachings of the present disclosure, the infant carrier can be configured according to any combination of the examples, features, and/or aspects of the disclosure described above and/or herein.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Infant carrier examples are disclosed herein that attempt to address one or more of the above-noted and/or other problems, disadvantages, and challenges with existing or prior known infant carriers. The disclosed infant carrier includes a shade that is detachable from the infant carrier. The disclosed shade is height adjustable relative to the main panel, once deployed. The disclosed shade can be stored in a pocket and can be deployed from the pocket for use. The disclosed infant carrier includes a cross-strap between the shoulder straps of the carrier. The cross-strap is height adjustable along the shoulder straps. The cross-strap includes one or more features, such as finger loops, that can be grasped by the caregiver wearing the infant carrier to adjust the height of the cross-strap. The disclosed infant carrier has a waist band that can accommodate different sized caregivers while still providing a safety catch feature for the waist band should the waist buckle of the waist band become unintentionally unbuckled during use. The waist band is configured to provide the safety catch feature in different waist size adjustment arrangements. These and other objects, features, and advantages of the disclosed infant carriers will become apparent to those having ordinary skill in the art upon reading this disclosure.

The drawings are not necessarily to scale. Thus, the proportions of the disclosed infant carrier and the relative positions of the various features and elements of the infant carrier can vary from the examples shown and described herein. The use of terms herein, such as "top", "bottom", "left, "right", "upper", "lower", "inner", "outer", "first", "second", and the like are meant only to differentiate among elements having similar names or different positions. Such terms are not intended to limit the scope of such elements to a particular order, side, height, or the like, except where expressly and specifically stated.

Figure 1:
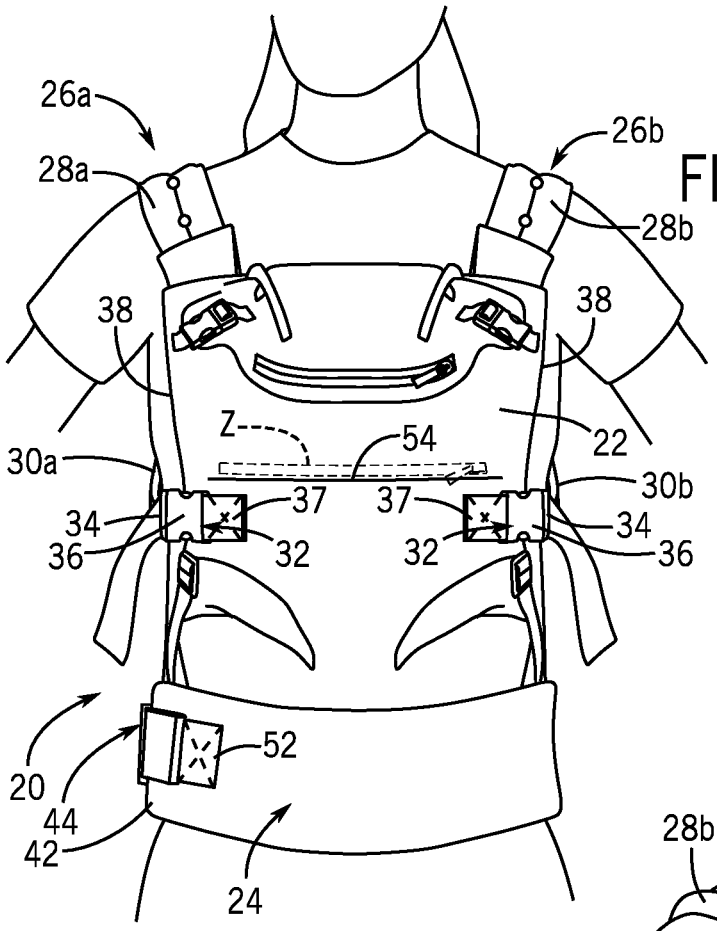
FIG. 1 shows a front view of an infant carrier constructed in accordance with the teachings of the present disclosure, the infant carrier being worn by a caregiver in a front carry position.
Figure 2:
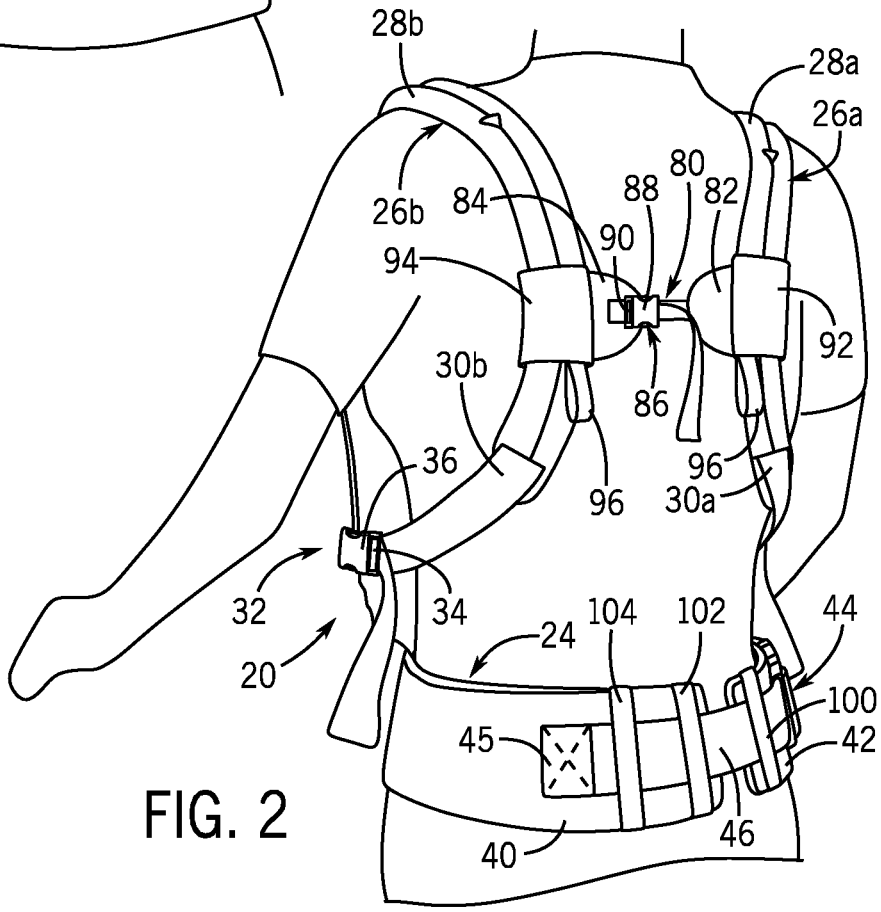
FIG. 2 shows a rear view of the infant carrier being worn by the caregiver in the front carry position of FIG. 1.

Turning now to the drawings, FIGS. 1 and 2 show one example of an infant carrier 20 (hereinafter "the carrier") in constructed accordance with the teachings of the present disclosure. The carrier 20 generally includes a main panel 22 and a waist band 24. The carrier 20 includes first and second shoulder straps 26*a*, 26*b*, i.e., left and right shoulder straps. The main panel 22 is configured to support an infant between the main panel and the body of a caregiver. The waist band 24 is generally configured to wrap around the waist or hips of a caregiver to secure the carrier 20 to the caregiver. The shoulder straps 26*a*, 26*b* are generally configured to extend over the respective shoulders of the caregiver to support an infant in the infant carrier 20 during use.

Each shoulder strap 26*a*, 26*b* has one end, i.e., a first end or upper end, 28*a*, 28*b*, respectively, that extends from the main panel 22. In this example, the first ends 28*a*, 28*b* may be integrally formed as a part of the material of the main panel 22 or may be sewn or otherwise joined to the material at the top corners of the main panel. Alternatively, the upper ends 28*a*, 28*b* of the shoulder straps 26*a*, 26*b* may be connected or fastened to the upper corners of the main panel 22, if desired. The upper ends 28*a*, 28*b* of the shoulder straps 26*a*, 26*b* may be padded for the comfort of the caregiver during use. Each shoulder strap 26*a*, 26*b* also has another end, i.e., a second end or a lower end 30*a*, 30*b*, that is detachably connectable to a portion of the carrier 20 at respective buckle assemblies 32.

Each lower end 30*a*, 30*b* can include a first part, such as a male part 34, of the buckle assembly 32 carried along the respective lower end. The male parts 34 can be slidable along a strap portion 35 of the lower ends 30*a*, 30*b* of the shoulder straps 26*a*, 26*b*, rendering the lower ends, and thus the shoulder straps, length adjustable. The male parts 34 can thus slide along the strap portions 35 on the lower ends 30*a*, 30*b* to adjust the overall length of the shoulder straps 26*a*, 26*b*. At least part of the lower ends 30*a*, 30*b* of the shoulder straps 26*a*, 26*b*, i.e., the portions excluding the strap portions 35, may also be padded for the comfort of the caregiver during use. Each buckle assembly 32 also has another part, such as second part or female part 36, carried on the carrier 20. In this example, the second or female parts 36 of the buckle assemblies 32 are connected to fixed length fabric tethers 37, which are disposed on or near the respective side edges 38 of the main panel 22. Also, in this example, the female buckle parts 36 are spaced above the waist band 24 and the tethers may be sewn or otherwise secured or fastened to the main panel.

In this example, the waist band 24 has a length and first and second free end sections 40 and 42 that extend outward beyond and relative to the side edges 38 of the main panel 22. The end sections 40 and 42 are detachably connectable to one another at a waist buckle 44 around the waist or hips of a caregiver. An adjustment strap 46 has a fixed end 45 attached to the first end section 40 of the waist band 24. The fixed end 45 may be sewn or otherwise secured to the material of the first end section 40. The fixed end 45 of the adjustment strap 46 is fixed to the first end section 40 spaced from the free end of the end section toward the main panel 22. The length of the adjustment strap 46 is such that the free or non-attached portion 47 of the adjustment strap 46 can extend well beyond the free end of the end section 40.

The waist buckle 44 has a first buckle part, such as a male connector 48, disposed along the adjustment strap 46. The male connector 48 can be moved along the strap to render the waist band 24 length adjustable. The waist buckle 44 has a second buckle part, such as a female connector 50, carried on the second end section 42 of the waist band 24. The female connector 50 is connected to a fixed length tether 52, such as a fabric tether. The tether 52 can also be sewn or otherwise secured to the material of the second end section 42 of the waist band 24. In this example, the female connector 50 is spaced a distance from the free end of the second end section 42 of the waist band 24.

The waist band 24, including the first and second end sections 40 and 42 may be padded, at least where the waist band contacts the waist or hips of a caregiver during use. The waist band 24 may be formed as one contiguous belt with a top edge connected to a bottom edge of the main panel 22, as in the disclosed example, and with the first and second end sections 40, 42 of the contiguous belt extending outward beyond the main panel. Alternatively, the waist band 24 may have two separate sections or parts either joined to one another near the middle of the waist band or joined to the side edges 38 of the main panel 22. In either case, the waist band 24 may be defined as having two segments or sections 40, 42, one extending from each side of the carrier 20, and each section defining one of the free ends.

As is known in the art, the carrier 20 may be reversible and/or reconfigurable and thus worn by a caregiver in different positions or orientations. FIGS. 1 and 2 show the carrier 20 worn in a front carry position with the main panel positioned against the chest of the caregiver. In this orientation, the waist band 24 wraps around the waist of the caregiver and the waist buckle 44 is connected to secure the waist band to the waist or hips of the caregiver. The upper ends 28*a*, 28*b* of the shoulder straps 26*a*, 26*b* extend up and over the shoulders of the caregiver from the chest side to the back side of the caregiver. The lower ends 30*a*, 30*b* extend back around and under the caregiver's arms. The buckle assemblies 32 are connected along the side edges 38 of the main panel 22.

Figure 3:
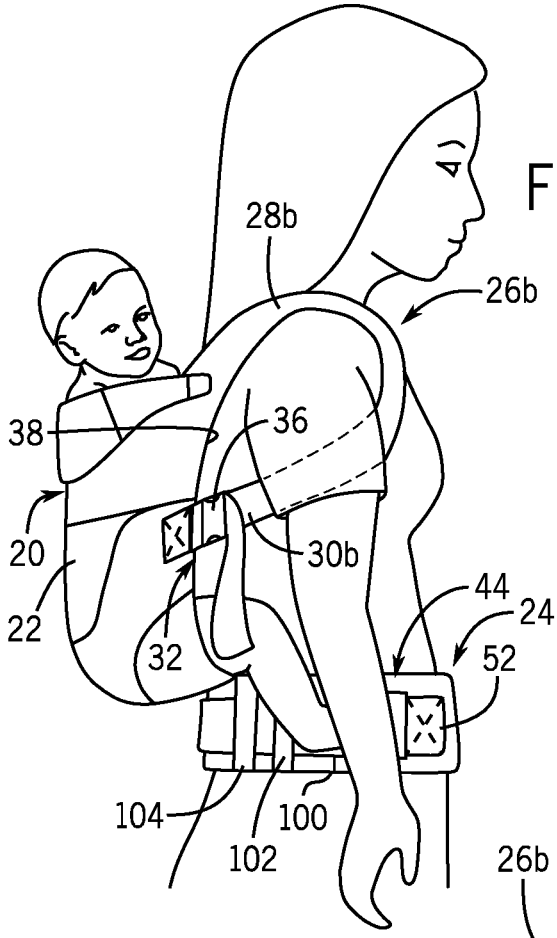
FIG. 3 shows a rear view of the infant carrier of FIGS. 1 and 2, but with the infant carrier being worn by a caregiver in a rear carry position.
Figure 4:
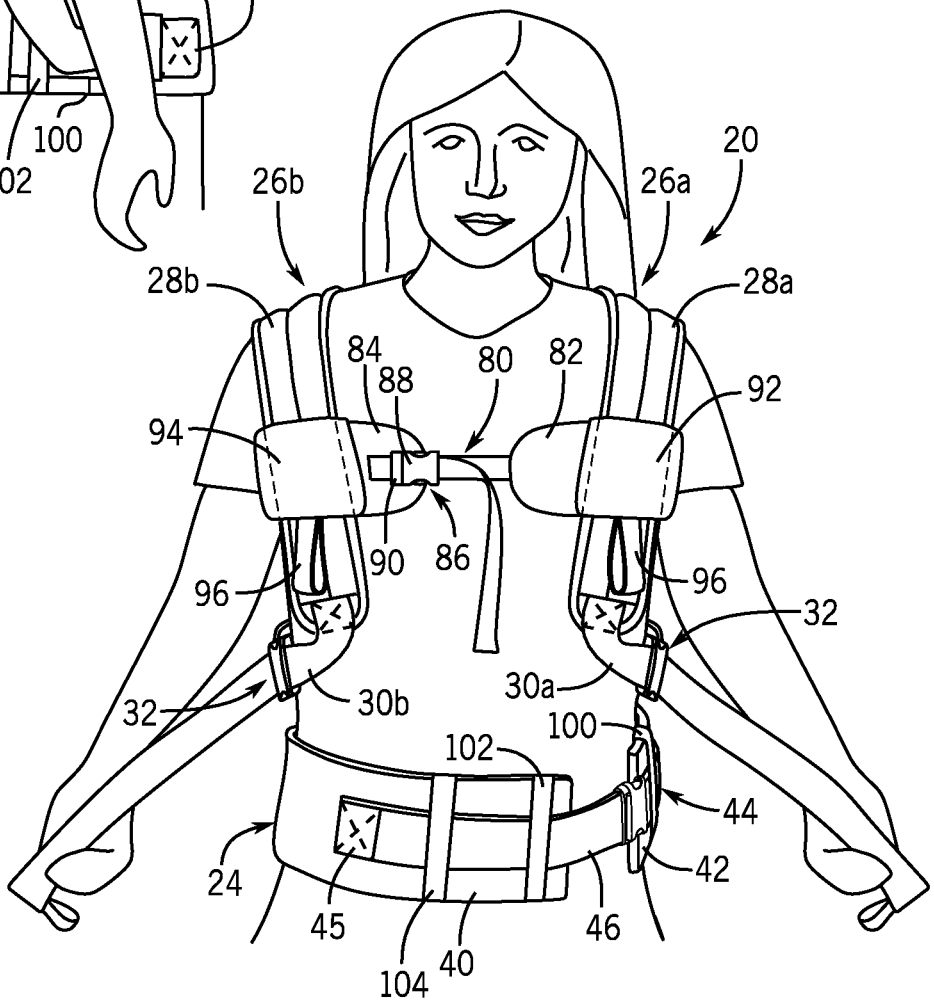
FIG. 4 shows a front view of the infant carrier being worn by the caregiver in the rear carry position.

As is known in the art, an infant can also be supported between the main panel 22 and the caregiver's chest in this front carry position. FIGS. 3 and 4 show the carrier 20 worn in a reverse back carry position with the main panel positioned against the back of the caregiver. In this orientation, the waist band 24 again wraps around the waist of the caregiver and the waist buckle 44 is connected to secure the waist band to the waist or hips of the caregiver. The upper ends 28*a*, 28*b* of the shoulder straps 26*a*, 26*b* extend up and over the shoulders of the caregiver from the back side to the chest side of the caregiver. The lower ends 30*a*, 30*b* extend forward around and under the caregiver's arms. The buckle assemblies 32 are again connected along the side edges 38 of the main panel 22. As is known in the art, an infant can be supported between the main panel 22 and the caregiver's back in this front carry position.

In the disclosed example, the position of the fixed female connector 50 and the length of the second end section 42 can be such that the waist buckle 44 is located at or near a side of the caregiver during use of the carrier in either of the front or back carry positions or orientations. This buckle arrangement allows a caregiver to reach the waist buckle 44 rather easily while mounting the carrier 20 to their torso. Thus, the waist band 24 in this example can allow a caregiver to mount the carrier 20 on their own body and adjust the size of the waist band without the assistance of another person. Another feature of the waist band 24 is discussed further below. In another example, though not shown or described herein, the carrier 20 may be reconfigured to be mounted in a side carry position on the caregiver's body where the main panel supports an infant on the caregiver's hip. The shoulder straps 26*a*, 26*b*, and particularly the adjustments straps can be reconfigured to secure the child in such a side carry position, if desired.

Figure 5A:
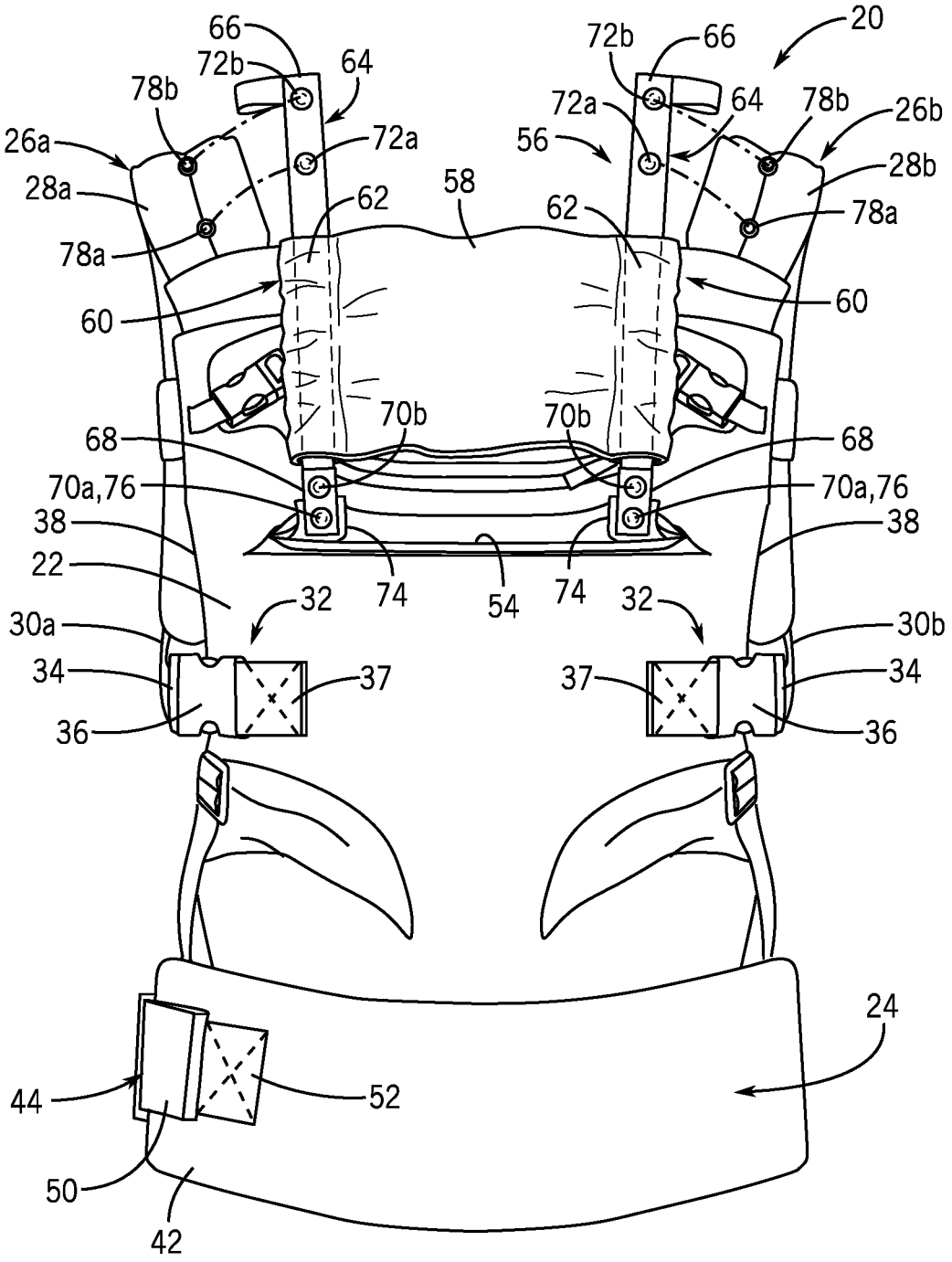
FIG. 5A shows a shade of the infant carrier constructed in accordance with the teachings of the present disclosure, the shade being deployed from a storage pocket of the infant carrier and depicted a low position on the infant carrier.

In one aspect of the present disclosure, as shown in FIGS. 1 and 5A, the carrier 20 can include multiple storage pockets, such as on the exposed or outer side of the main panel 22. In one example, one pocket 54 can be provided on the main panel 22 to store a shade 56 therein. The shade 56 may be a sun shade, hood, cover, weather barrier, light barrier, or the like, i.e., a material layer. The shade 56 is stowable in the pocket 54 and is deployable from the pocket to cover and/or protect an infant or at least the infant's head while supported in the carrier. Hereinafter, the term "shade" is broadly used to encompass any deployable material layer for use as a sun shade, hood, cover, barrier, and/or the like and these terms may be used interchangeably herein. The pocket 54 can be a zippered storage pocket formed between layers of the main panel 22 or can be a separate pocket added to the material of the main panel 22. The pocket can have a top opening into the pocket that is closed off by a zipper Z.

Figure 5B:
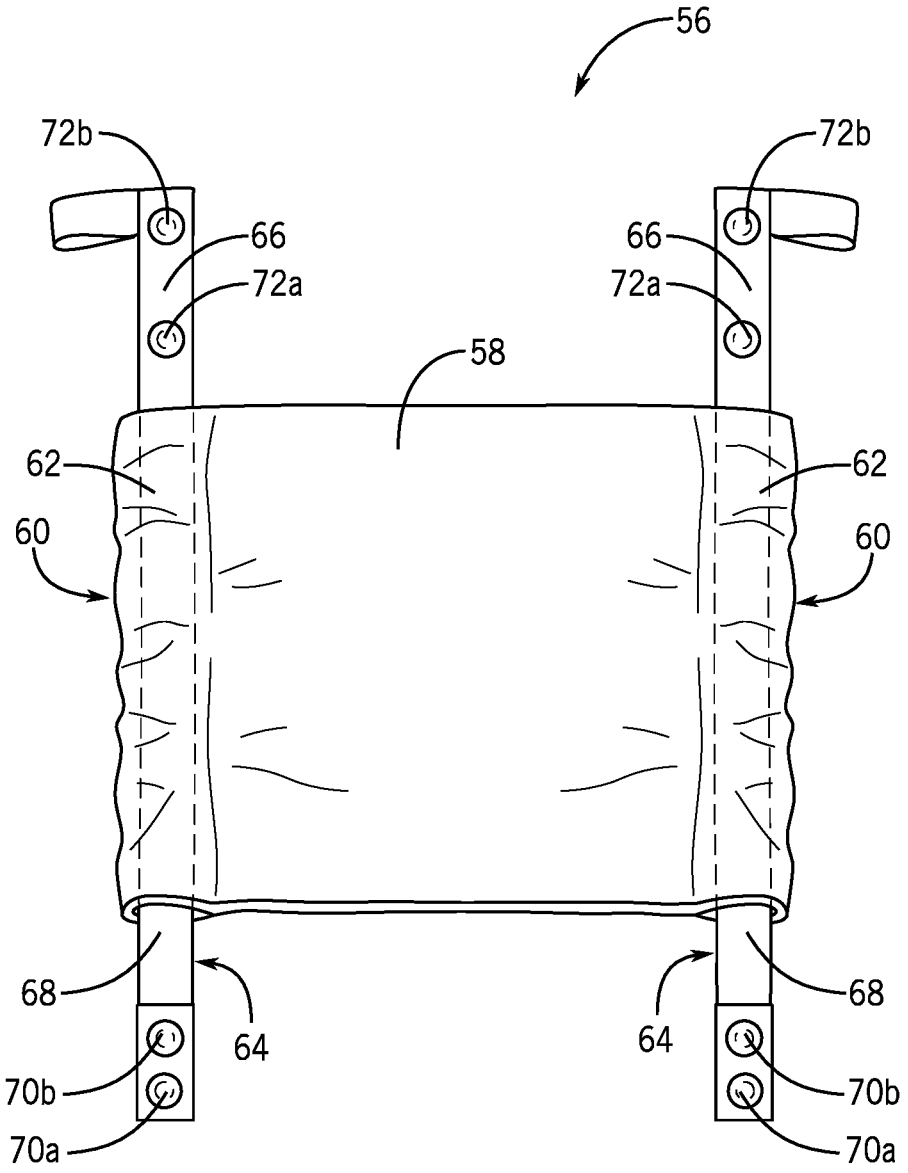
FIG. 5B shows the shade of FIG. 5A detached from the infant carrier.

The shade 56 in this example is tethered to the carrier 20 and is removable or selectively detachable from the carrier as well. As shown in FIG. 5B, the shade 56 can be entirely detached form the carrier 20, if desired. This can leave the pocket 54 available for storing other items, if needed or preferred by the caregiver. The shade 56 in this example is also height adjustable relative to the main panel 22 once deployed from the pocket 54. As show in FIGS. 5A and 5B, the shade 56 has a panel 58 with opposed side edges 60. The panel 58 can be formed of a natural or synthetic fabric or other suitable material. The shade 56 has sewn tunnels or sleeves 62 along the side edges 60. A strap or webbing 64 is threaded along and through each of the sleeves 62 with an exposed top end 66 of the webbing and an exposed bottom end 68 of the webbing protruding from the respective sleeves 62 at the top and bottom edges of the panel 58. The top ends 66 and the bottom ends 68 of the webbings 64 can include connectors of some type, such as male/female snaps, snap elements, buttons/holes or the like, for detachably connecting the webbing, and thus the shade 56, to portions of the carrier 20.

In this example, a pair of lower snaps 70*a* and 70*b* are provided near the bottom ends 68 of the webbings 64. The lower snaps 70*a*, 70*b* are closely spaced apart in the lengthwise direction along the webbings 64. Another pair of upper snaps 72*a*, 72*b* are provide on the top ends 66 of the webbings 64. The upper snaps 72*a*, 72 are spaced apart from one another also in the lengthwise direction along the webbings 64. In this example, a tab 74, such as a fabric tab, is provided on the interior of the pocket 54, near the opening into the pocket. Each tab 74 is provided with a corresponding snap 76, which can be connected to one of the lowermost snaps 70*a* on the respective webbings 64 to removably or detachably connect the shade 56 to the carrier 20. The bottom ends 68 of the webbings 64 are removably or detachably connected to the carrier 20 via the snaps 70*a* and 76. The shade 56 can remain connected to the carrier 20 while the shade is stowed within the pocket 54 (see FIG. 1) and when deployed from the pocket, as shown in FIG. 5A. The shade 56 can be detached from the carrier, as shown in FIG. 5B, by disengaging each snap 70*a* from the corresponding snap 76 of the tabs 74.

In another example, though not shown herein, the webbings 64 can be fixed to the carrier 20 within the pocket 54. The panel 58 in either example can instead be detached for the carrier 20 by sliding the sleeves 62 off the top ends of the corresponding webbings. Thus, the shade may be removable from the carrier or the panel of the shade may be removable from the webbing in order to detach the shade or panel from the carrier.

In this example, each shoulder strap 26*a*, 26*b* includes two snaps 78*a* and 78*b* that are spaced apart from one another in a lengthwise direction along the respective shoulder strap. When the shade 56 is deployed from the pocket 54, as depicted in FIG. 5A, the top ends 66 of the webbings 64 may be connected to the respective shoulder straps 26*a*, 26*b* of the carrier 20 to retain the shade 56 and the panel 58 in a position to extend over a top portion of the main panel 22 and above the main panel. More specifically, the panel 58 of the shade 56 is intended to be positioned to be able to cover the infant or the infant's head during use of the carrier 20 and when deployed. The snaps 72*a* and 72*b* on the top ends 66 of the webbings 64 can be connected to the snaps 78*a* and 78*b* one the respective shoulder straps 26*a* and 26*b* to retain the shade in the deployed position. To permit some adjustability in the tension of the webbings and/or the position of the panel, the snaps 72*a*, 72*b* can be connected to the snaps 78*a*, 78*b* is various configurations, For example, the lower snaps 72*a* on the top ends 66 of the webbings 64 can be connected to the lower snaps 78*a* on the shoulder straps 26*a*, 26*b* and the upper snaps 72*b* can be connected to the upper snaps 78*b*. Alternatively, the lower snaps 72*a* on the top ends 66 of the webbings 64 can be connected to the upper snaps 78*b* on the shoulder straps 26*a*, 26*b* or the upper snaps 72*b* on the webbings 64 can be connected to the lower snaps 78*a* on the shoulder straps 26*a*, 26*b* for different configurations.

Figure 6:
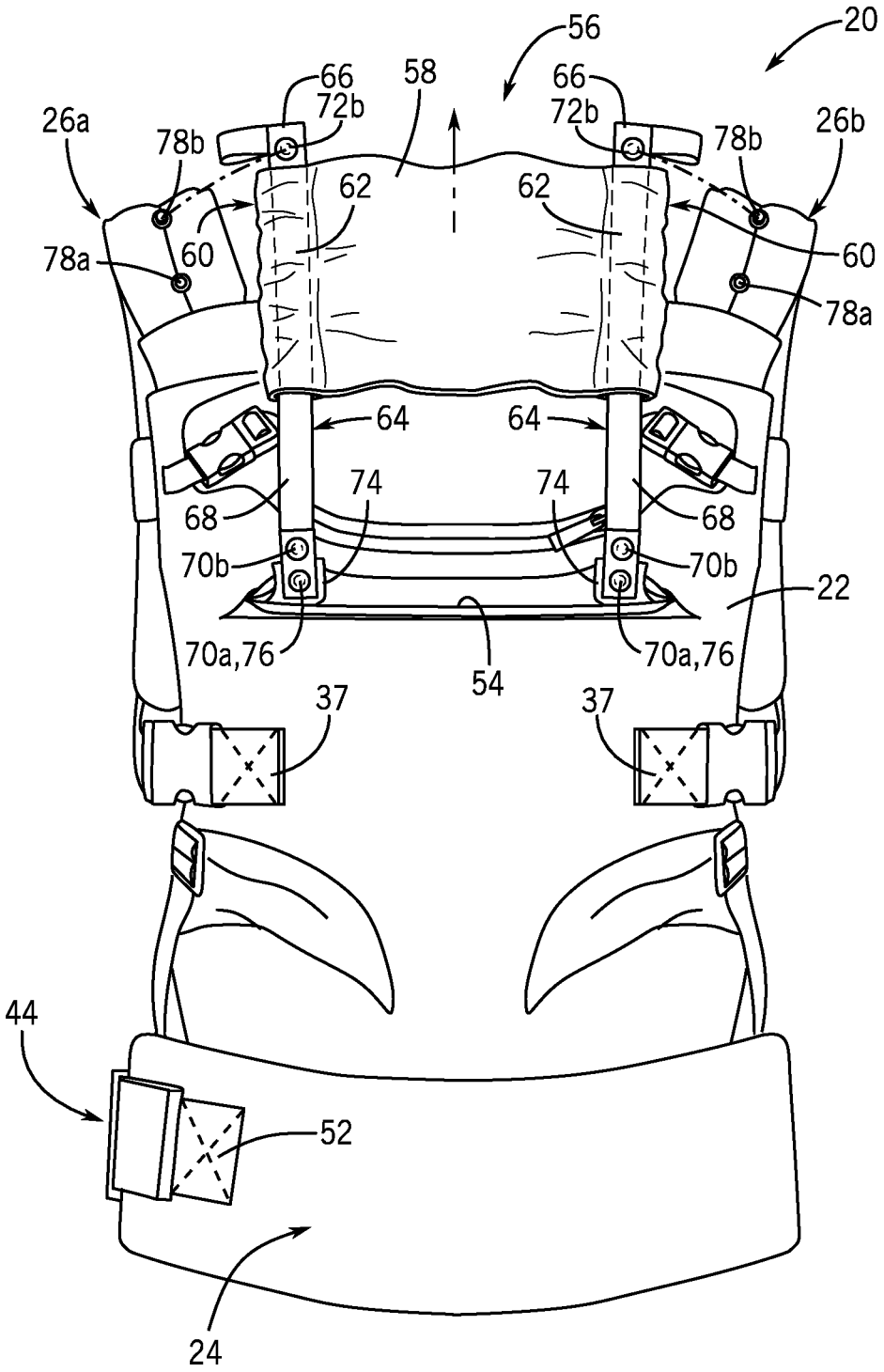
FIG. 6 shows the shade of FIG. 5A adjusted to a higher position on the infant carrier.

The shade 56 is storable in the pocket 54 on the main panel 22 and may be rolled up or folded to fit within the pocket. When deployed, the shade 56 is withdrawn from the pocket and the webbings 64 are extended. The snaps 72*a*, 72*b* and 78*a*, 78*b* can be connected in the desired configuration. In this example, as shown in FIGS. 5A and 6, the panel 58 of the shade 56 is also height adjustable along the webbings 64. The panel 58 is slidable along the webbings 64 via the sleeves 62 to adjust the height position of the panel relative to the main panel 22 on the carrier 20. The height of the panel 58 can be adjusted to any desired position along the webbings 64 between a lowermost height and an uppermost height [permitted by the sleeve length and webbing length. The shade and panel can thus be attached and moved to accommodate different sized and/or different aged infants while in the carrier 20.

Figure 7:
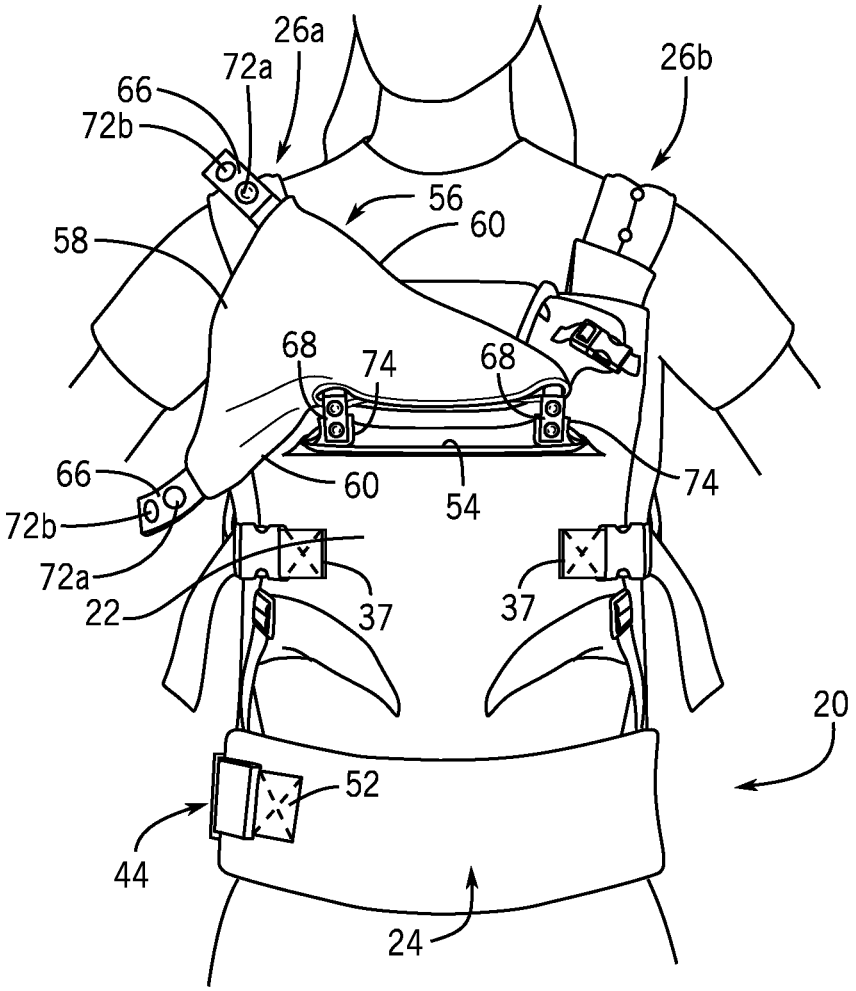
FIG. 7 shows the shade in an alternate coverage position on the infant carrier.
Figure 8:
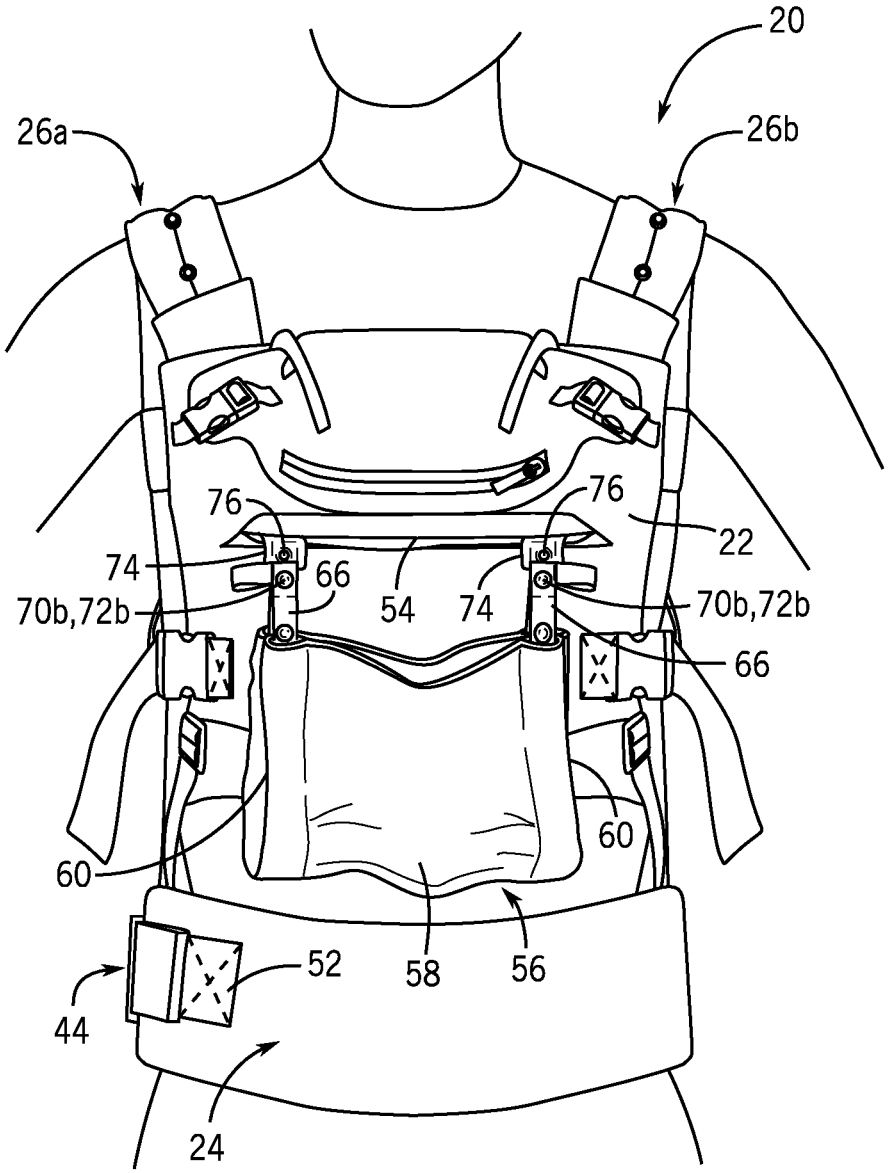
FIG. 8 shows the shade of FIG. 5A in a dropped or lowered position below the storage pocket on the infant carrier.

As shown in FIGS. 7 and 8, the shade 56 may be positioned in different or alternative positions on the carrier 20. In one example, the shade may be positioned in a side cover or breastfeeding position, as depicted in FIG. 7. This position can be created by detaching the top ends 66 of the webbings 64 from the corresponding shoulder straps 26*a*, 26*b*, crossing one of the top ends over to the other or opposite side shoulder strap, and then attaching that webbing to the opposite shoulder strap via the snaps 72*a* or 72*b* and the snaps 78*a* or 78*b*. The detached side of the shade 56 and webbing 64 can then hang loose to the side of the caregiver during use, such as while breastfeeding. In another example, the shade 56 can be deployed in a folded down position, outside of the pocket 54, when not in use, while remaining ready to be deployed, as depicted in FIG. 8. In this position, the webbing top ends 66 can be snapped onto the webbing bottom ends 68 via the snaps 72*b* (or 72*a*) at the top ends and the snaps 70*b* on the bottom ends 68 of the webbings 64. In another example, the tabs 74 may be provided with an extra snap for this function instead of providing the second snaps on the bottom ends 68 of the webbings 64. In this position, the top ends 66 of the webbings 64 are not attached at a higher or in use position on the carrier but instead are attached to the bottom ends 68 of the webbings so that the shade 56 hangs from the main panel 22 outside of the pocket 54. In the position of FIG. 8, the shade 56 can remain attached to the carrier 20 when not in use, which leaves the pocket 54 available to store other items if desired. With the shade 56 folded in this configuration, however, the shade is shorter than its full length, including the length of the webbings 64 and the panel 58, and thus less likely to become an obstruction or a hazard while hanging outside of the pocket 54.

The webbings may be attachable to the carrier at different locations than the disclosed locations than in this disclosed example. Multiple attachment connectors, snaps, buttons, holes, locations, or the like may be provided on the shoulder straps, the main panel, or other parts of the carrier to further allow adjustability of the shade position and location relative to the carrier during use and when stored or stowed.

In the disclosed example, the shade 56 is a height adjustable shade on the carrier 20 and is not permanently attached to the carrier. The disclosed panel 58 of the shade 56 is designed to be free to move up and down on the webbings 64. Also, the webbings 64 can be attached at different heights on the shoulder straps 26*a*, 26*b* and/or carrier 20. This allows the cover to accommodate children of different sizes and growth stages. In the disclosed example, the shade 56, or at least the panel 58 (not the webbings), is also removable or detachable from the carrier 20. Thus, if desired, the shade or panel can be removed so that it does not get in the way or otherwise impede use of the carrier, once the child no longer uses the shade or when the shade or panel is not needed.

The disclosed shade thus allows for a variety of ways to provide additional coverage for an infant and caregiver including by sliding the panel freely along the webbings. The shade may be used for breastfeeding and/or sleeping privacy and allows the panel to be used as protective coverage for the infant as they grow. The shade can be used for sun/weather protection and can also aid in supporting an infant's head when they fall asleep and/or to simply cover the infant's head while they sleep. The disclosed shade also allows a caregiver to completely remove the shade or the panel when it is no longer used or required. The removable shade allows the caregiver to snap/attach the shade in an "up" or raised position and allows the panel height to be adjusted when deployed out of the storage pocket and reduces the amount of shade material that will hang down.

In other words, the disclosed shade allows for use as coverage for privacy for the caregiver for feeding and for coverage for sun/weather protection for the infant. The shade can also be deployed for additional support for the head when the infant is asleep. The amount of support may be dictated by how the various snaps are arranged and utilized, which in turn dictates how much tension is utilized in the webbings when deployed and attached to the shoulder straps.

Figure 9:
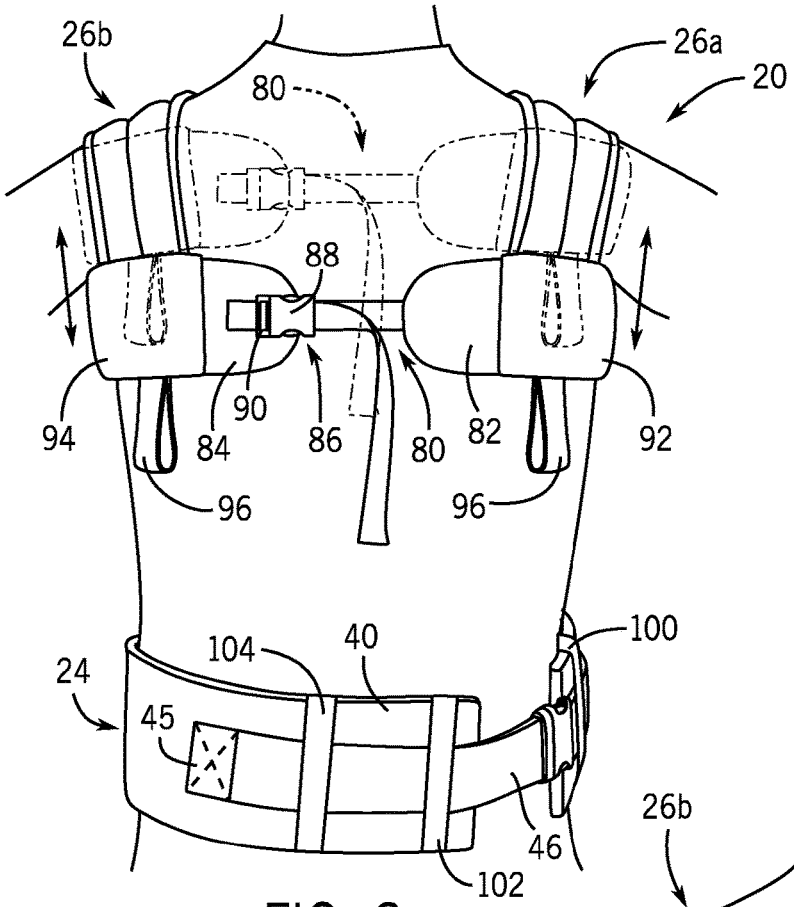
FIG. 9 shows a rear view of the infant carrier of FIGS. 1 and 2 in the front carry position and with the cross-strap being height adjustable on the shoulder straps on the infant carrier.

In another aspect of the present disclosure, as shown in FIGS. 2, 4, and 9, the carrier 20 in this example also has a yoke, i.e., a cross-strap 80 that extends between the shoulder straps 26*a*, 26*b*. The cross-strap 80 is slidable along the first and second shoulder straps 26*a*, 26*b* in a vertical direction such that the cross-strap is height adjustable. The cross-strap 80 is also length adjustable in a width-wise direction to draw the shoulder straps 26*a*, 26*b* closer together or to space them further apart. Thus, the cross-strap 80 can be adjusted to accommodate caregivers of different size and height. As noted above, the carrier 20 is reversible and thus can be configured to be selectively worn on the front or chest side of a caregiver and on a back of the caregiver. The adjustable yoke or cross-strap 80 allows for greater comfort and adjustability to accommodate different sized caregivers and use in both positions.

In this example, the cross-strap 80 has a first strap section 82 that is carried on the first shoulder strap 26*a* and has a second strap section 84 that is carried on the second shoulder strap 26*b*. The first and second strap sections 82, 84 can each have a free end that is connectable to and detachable from one another via a chest buckle 86. The chest buckle 86 can include a first part 88 carried on the first strap section 82 and a second part 90 carried on the second strap section 84. The buckle parts 88, 90 can form the chest buckle 86 when connected to one another and can also be configured to render the cross-strap 80 having a length that is adjustable between the shoulder straps 26*a*, 26*b*.

The first and second strap sections 82, 84 are slidably connected to the respective first and second shoulder straps 26*a*, 26*b*. The strap sections 82, 84 may be so connected in a variety of different ways while allowing the vertical sliding adjustment relative to the respective shoulder straps 26*a*, 26*b*. In this example, the first strap section 82 has a ring portion 92, i.e., a hoop or ring of material that wraps around or circumvents the first shoulder strap 26*a*. Likewise, the second strap section 84 has a ring portion 94, i.e., a hoop or ring of material that wraps around or circumvents the second shoulder strap 26*b*. Stops may be provided, though not shown herein, along the shoulder straps, if desired, to limit the amount of travel of the loop portions 92, 94 along the shoulder straps 26*a*, 26*b*, respectively. In one example, each of the ring portions 92, 94 may be a circle or ring of fabric material that wraps around the respective shoulder strap.

As shown in FIGS. 2, 4, and 9, the cross-strap 80 also includes one or more tabs, flaps, finger loops, ring tabs, or the like that extend therefrom. In this example, each of the strap sections 82, 84 has a finger loop 96 that extends down from or near a lower edge of the respective section. The finger loops 96 can be formed so that a caregiver can access and grasp the finger loop 96 whether the carrier is worn on the front or the back. Once grasped, the caregiver can easily adjust the height of the cross-strap 80 on the shoulder straps 26*a*, 26*b* to a comfortable position. The finger loops 96 can be designed, i.e., sized and positioned, to allow for pulling down on the cross-strap 80. Alternatively, the finger loops 96 can be substituted by another element, such as a tab, a handle, a protrusion, a flap, or other suitable element that can be configured to allow for pulling up, pushing up, pulling down, and/or pushing down of the cross-strap along the shoulder straps, if desired, by a caregiver. During use, a caregiver may be instructed to or may choose to adjust the cross-strap 80 to its highest position before putting the carrier on their torso. Once the carrier is attached in worn, the caregiver can then pull the cross-strap 80 down, if needed, the desired height on the shoulder straps 26*a*, 26*b*, by using the finger loops 96.

In one example, the finger loops 96 can be provided as a loop of webbing or strap material. In this example, a finger loop 96 is attached to or provided on each of the first and second strap sections of the yoke. The finger loops 96 can be configured to receive a finger or a thumb of a caregiver. Further, each finger loop 96 can be configured and positioned to permit the caregiver to use either hand and to reach from either side of their body in order to adjust the cross-strap position.

In this example, the finger loops 96 allow a caregiver to adjust the cross-strap 80 position, such as by pulling the yoke down, without the need of help from a second person. This is particularly useful when the carrier 20 is worn in the front carry mode, which places the cross-strap 80 on the caregiver's back. This allows the caregiver to position the cross-strap 80 to their comfort on their own. In this example, the finger loops 96 are loops of webbing material that are added to the bottom of the cross-strap 80, one on each strap section 82, 84. The caregiver can reach behind their back, place a finger or thumb within the desired loop 96 (or simply grasp the loop, and pull the loop or loops down to adjust the cross-strap 80, without assistance, when the carrier 20 is used in the front carry mode.

Figure 10:
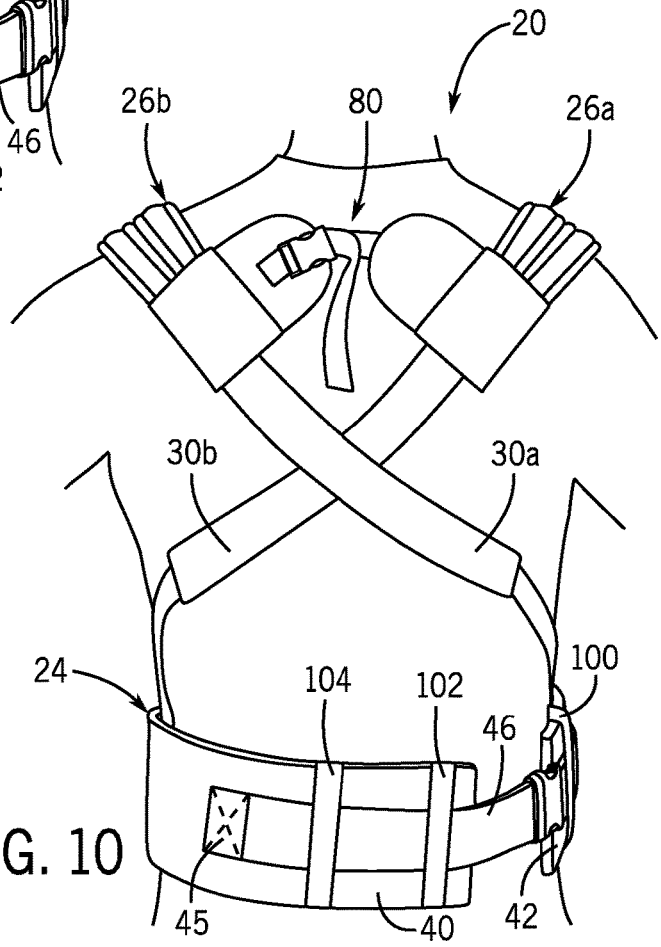
FIG. 10 shows a rear view of the infant carrier in the front carry position of FIGS. 1 and 2 but with the shoulder straps in an alternate crisscross configuration.

FIGS. 2, 4, and 10 show that the shoulder straps 26*a*, 26*b* of the disclosed carrier 20 can be used in at least two different modes or positions, other than the above mentioned (but not shown) side carry position or configuration). One mode is depicted in FIGS. 2 and 4 and may be identified as a normal, standard, backpack, or straight mode. In this mode, the shoulder straps 26*a*, 26*b*, i.e., the left and right straps, remain on their designated side of the caregiver's body and remain separated from one another. The cross-strap 80 then is disposed between the shoulder straps as in FIGS. 2 and 4. In other words, the second or lower end 30*a*, 30*b* of each shoulder strap 26*a*, 26*b* is connected to the same side of the main panel 22 on the carrier 20 as the corresponding first or upper end 28*a, b*28*b* of each shoulder strap.

Another mode is depicted in FIG. 10 and may be identified as the crisscross mode. In this mode, the shoulder straps 26*a* and 26*b* are crossed over one another on the caregiver's back in the front carry mode (or the caregiver's chest in the back carry mode). In this mode, the second or lower end 30*a*, 20*b* of each shoulder strap 26*a*, 26*b* is connected to the opposite side of the main panel 22 on the carrier 20 as the corresponding first or upper end 28*a*, 28*b* of each shoulder strap. In this example, the cross-strap 80 may be disconnected or unlatches, or may be connected or latched, as shown in FIG. 10. The caregiver can select the shoulder strap mode that best suits their needs or comfort when wearing the carrier 20.

In yet another aspect of the present disclosure, FIGS. 2, 4, and 11-13 show that the waist band 24 in this example is configured to allow for comfort to a wider range of caregivers having a greater waist size range. The waist band 24 in this example has a first guide band, i.e., a safety 100 on the outer facing side of the second end section 42. The safety loop 100 is positioned spaced from the free end of the second end section 42. The female connector 50 is fixed to the second end section 42 spaced further from the free end than the first guide band or safety loop 100. The waist band 24 in this example also has second and third guide bands 102 and 104 disposed on the outer surface of the first end section 40. The second guide band 102 is positioned spaced from the free end of the first end section 40. The third guide band 104 is positioned spaced from the second guide band 102 and spaced further from the free end of the first end section 40. The fixed end 45 of the adjustment strap 46 is attached to the first end section 40 spaced still further from the free end than both the second and third guide bands 102, 104.

The safety loop 100 and guide bands 102 and 104 are configured and positioned to provide a safety catch to grab and retain a buckle part, i.e., the male connector 48 or the female connector 50 of the waist band 24, should the waist buckle 44 come undone while a user wear's and uses the carrier 20. The safety loop 100 and guide bands 102 and 104 help to prevent the waist band 24 from becoming completely separated and dislodged unintentionally during use. In this example, the second end section 42 of the waist band 24 has one guide loop, i.e., the safety loop 100, whereas the first end section 40 of the waist band 24 has one guide band, i.e., the second guide band 102 and at least one additional guide band, the third guide band 104 thereon. The first end section 40 may thus be described as having a plurality of guide bands spaced apart from one another over a length of the first end section of the waist band 24 near that free end.

Figure 11:
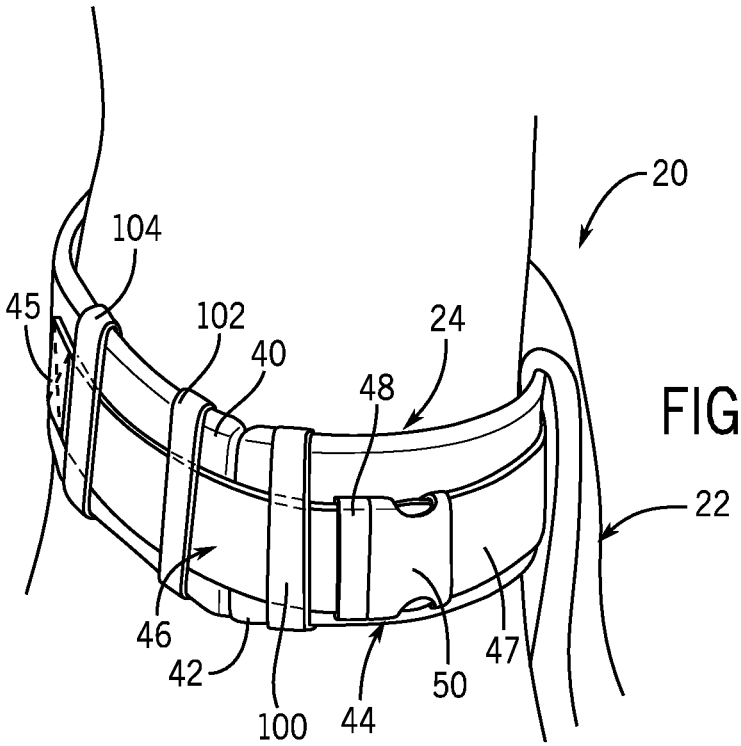
FIG. 11 shows the waist belt of the infant carrier of FIGS. 1-4, and in large waist size arrangement.

How the safety loop 100 and guide bands 102 and 104 are used depends on the waist size of the caregiver during use. FIGS. 2, 4, and 11 show a waist band 24 arrangement for a caregiver with a larger sized waist. In this arrangement all three loops and guide bands 100, 102, and 104 may be utilized. The adjustment strap 46 and male connector 48 can be threaded between the third and second guide bands 104 and 102 and the outer surface of the first end section 40. The male connector 48 can also be threaded between the first guide band, i.e., the safety loop 100 and the outer surface of the second end section 42 and then connected to the female connector 50 to secure the waist band 24 around the waist or hips of the caregiver. Should the waist buckle become undone, the first guide band or safety loop 100 will help prevent the male connector 48 from passing back between the guide band and the outer surface of the second end section 42 and instead catch the male connector. Thus, the first guide band or safety loop 100 can hold the male connector 48 and thus maintain the waist band 24 in a semi-secured arrangement around the caregiver's waist or hips with the waist buckle 44 disengaged. The second and third guide bands 102 and 104 can aid in maintaining the waist band shape and alignment of the two end sections 40, 42 with one another by guiding and retaining the adjustment strap 46 aligned with the first end section 40.

Figure 12:
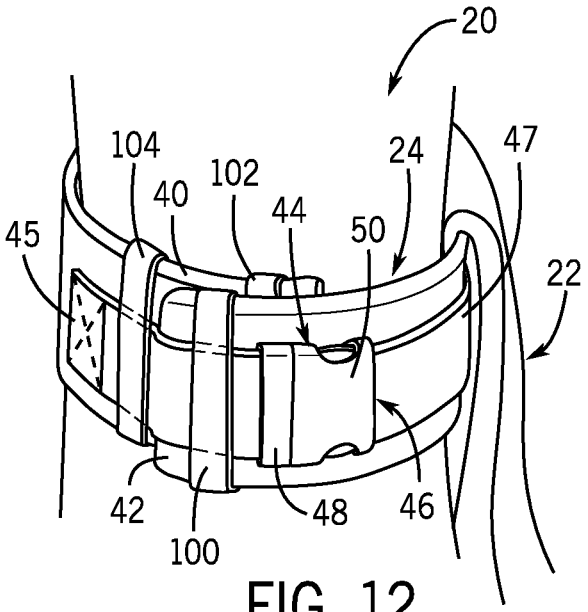
FIG. 12 shows the waist belt of FIG. 11, but in a medium waist size arrangement.

FIG. 12 shows a waist band 24 arrangement for a caregiver with a mid-sized or medium sized waist. In this arrangement only the first and third guide bands 100 and 104 may be utilized. The adjustment strap 46 and male connector 48 can be threaded between the third guide band 104 and the outer surface of the first end section 40. The free end of the first end section 40, including the second guide band 102, can be positioned behind or against the inner surface of the second end section 42. The male connector 48 can then also be threaded between the first guide band or safety loop 100 and the outer surface of the second end section 42 and then connected to the female connector 50 to secure the waist band 24 around the waist or hips of the caregiver. Should the waist buckle become undone, the first guide band or safety loop 100 again will help hold the male connector 48 and thus maintain the waist band 24 in a semi-secured arrangement around the caregiver's waist or hips with the waist buckle 44 disengaged. The third guide band 104 can aid in maintaining the waist band shape and alignment of the two end sections 40, 42 with one another by guiding and retaining the adjustment strap 46 aligned with the first end section 40.

Figure 13:
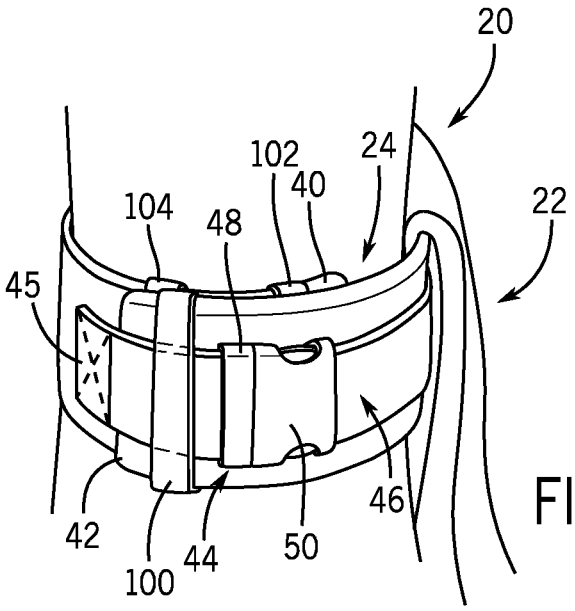
FIG. 13 shows the waist belt of FIG. 11, but in a small waist size arrangement.

FIG. 13 shows a waist band 24 arrangement for a caregiver with a smaller sized waist. In this arrangement only the first guide band or safety loop 100 may be utilized. The free end of the first end section 40, including the second and third guide bands 102 and 104, can be positioned behind or against the inner surface of the second end section 42. The male connector 48 can then be threaded between the first guide band 100 and the outer surface of the second end section 42 and then connected to the female connector 50 to secure the waist band 24 around the waist or hips of the caregiver. Should the waist buckle become undone, the first guide band or safety loop 100 again will help hold the male connector 48 and thus maintain the waist band 24 in a semi-secured arrangement around the caregiver's waist or hips with the waist buckle 44 disengaged.

The safety loop 100 and guide bands 102 and 104 thus can help to retain and hold the excess adjustment strap 46 and waist band length in alignment with the waist band 24 during use. The waist band 24 can thus be provided with a substantial length of padded waist band section in order to accommodate individuals of larger waist size. For individuals of smaller waist size, the excess padded part of the first end section 40 can be overlapped with the second end section 42. The first guide band, i.e., safety loop 100 acts as a safety catch for the male 48 connector of the adjustment strap 46 where the male connector and female connector 50 become inadvertently or unintentionally disengaged during use.

The first end section 40 can include more than two of the guide bands, if desired, for more length adjustability or more intermediate positions. The second end section 42 can also include a second guide band, if desired, as an additional safety catch. Also, as noted above, the waist band 24 may have or is described as having first and second band segments, i.e., the first and second end sections 40, 42. Each of the segments can have one end joined to the carrier (or to the other segment) and each segment can extend away from the main panel in opposite directions. Each waist band segment then can have a free end that is connectable in some way to the fee end of the other segment. Either one of the waist band segments can employ the multiple guide bands.

The additional guide bands on the waist band 24 allows for the waist band circumference to be sized for smaller waist sizes. The second or added guide bands allow one free end of the waist band to be positioned under the opposite free end so that the two free ends can overlap one another but remain in alignment with one another. This permits the waist band to be adjusted to a smaller circumference for a better fit on smaller waists.

An infant carrier may be constructed according to the teachings of the present disclosure by including any one or more of the above-disclosed features either alone or in any combination, apart from the specific embodiments disclosed and/or described herein.

Although certain infant carriers and features have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. An infant carrier comprising:

a main panel configured to support an infant between the main panel and a caregiver;

first and second shoulder straps each having one end extending from the main panel and another end detachably connectable to a portion of the infant carrier;

a waist band disposed at a lower end of the main panel; and a shade attached to and selectively detachable from the infant carrier, the shade being deployable to cover and extend above at least a top portion of the main panel, wherein the shade further includes a panel with side edges, each side edge retained on a respective webbing such that the panel is slidable along the webbings to adjust a height of the panel on the infant carrier, and wherein the webbings each have an exposed lower end with a snap that is engageable with a corresponding snap carried on the main panel.

2. The infant carrier of claim 1, further comprising:

a pocket on the main panel, the shade storable in the pocket and deployable from the pocket.

3. The infant carrier of claim 1, wherein each side edge of the panel includes a sleeve, and wherein each the webbings is threaded through a respective one of the sleeves.

4. The infant carrier of claim 1, wherein the webbings are each removable from and attachable to the main panel, the first and second shoulder straps, or both.

5. The infant carrier of claim 1, further comprising:

a pocket on the main panel, the shade storable in the pocket and deployable from the pocket; and at least two tabs carried on the main panel, one tab disposed near each opposed side of the pocket and within the pocket, wherein one of the corresponding snaps is carried on each of the tabs.

6. The infant carrier of claim 1, wherein the webbings each have an exposed upper end with a snap on the upper end that is engageable with a corresponding snap carried on each of the shoulder straps, respectively, when deployed.

7. The infant carrier of claim 6, wherein each shoulder strap has at least two corresponding snaps carried thereon, the snap on the upper end of each of the webbings selectively connectable to either of the at least two corresponding snaps on the respective shoulder strap.

8. The infant carrier of claim 6, wherein the webbings each have a second snap on the lower end, the second snap connectable to the snap on the respective lower end to deploy the shade in a folded hanging position outside of a shade storage pocket.

9. The infant carrier of claim 1, wherein the infant carrier is configured to be selectively worn on at least a chest side of a caregiver and on a back of the caregiver.

10. The infant carrier of claim 1, further comprising:

a cross-strap extending between and slidable along the first and second shoulder straps such that the cross-strap is height adjustable.

11. The infant carrier of claim 10, wherein the cross-strap has a first strap section carried on the first shoulder strap and a second strap section carried on the second shoulder strap, wherein the first and second strap sections are connectable to and detachable from one another, and wherein a length of the cross-strap between the shoulder straps is adjustable.

12. The infant carrier of claim 10, wherein the cross-strap has a first strap section with a ring portion circumventing the first shoulder strap and has a second strap section with a ring portion circumventing the second shoulder strap.

13. The infant carrier of claim 12, wherein the cross-strap has one or more finger loops extending therefrom, and wherein the one or more finger loops is configured to be grasped by a caregiver to adjust the height of the cross-strap.

14. The infant carrier of claim 13, wherein a first finger loop of the one or more finger loops extends from the first strap section and a second finger loop of the one or more finger loops extends from the second strap section, and wherein each of the first and second finger loops is configured to receive a finger or a thumb of a caregiver.

15. The infant carrier of claim 10, wherein the cross-strap has at least one finger loop extending therefrom, and wherein the at least one finger loop is configured to be grasped by a caregiver to adjust the height of the cross-strap.

16. An infant carrier comprising:

a main panel configured to support an infant between the main panel and a caregiver;

first and second shoulder straps each having one end extending from the main panel and another end detachably connectable to a portion of the infant carrier;

a waist band disposed at a lower end of the main panel; and a shade attached to and selectively detachable from the infant carrier, the shade being deployable to cover and extend above at least a top portion of the main panel, wherein the waist band further includes a first end section extending outward relative to one side edge of the main panel, a second end section extending outward relative to another side edge of the main panel opposite the one side edge, a waist buckle having a first connector and a second connector, the first connector fixed to the second end section spaced from a free end thereof, an adjustment strap fixed to the first end section at a fixing location spaced from a free end thereof, the second connector adjustably carried on the adjustment strap, a first guide band carried on the second end section between the free end thereof and the first connector, and a second guide band and a third guide band carried on the first end section between the free end thereof and the fixing location of the adjustment strap, the second guide band positioned closer to the free end and the third guide band positioned closer to the fixing location, wherein the second connector of the waist buckle is threaded through only the first guide band and connected to the first connector in a small waist arrangement of the waist band, wherein the second connector of the waist buckle is threaded through the third and the first guide bands and connected to the first connector in a mid-sized waist arrangement of the waist band, and wherein the second connector of the waist buckle is threaded through the third, second, and first guide bands and connected to the first connector in a large waist arrangement of the waist band.

17. An infant carrier comprising:

a main panel configured to support an infant between the main panel and a caregiver;

first and second shoulder straps each having one end extending from the main panel and another end detachably connectable to a portion of the infant carrier; and a waist band disposed at a lower end of the main panel, the waist band including a first end section extending outward relative to one side edge of the main panel, a second end section extending outward relative to another side edge of the main panel opposite the one side edge, a waist buckle having a first connector and a second connector, the first connector fixed to the second end section spaced from a free end thereof, an adjustment strap fixed to the first end section at a fixing location spaced from a free end thereof, the second connector adjustably carried on the adjustment strap;

a first guide band carried on the second end section between the free end thereof and the first connector, and a second guide band and a third guide band carried on the first end section between the free end thereof and the fixing location of the adjustment strap, the second guide band positioned closer to the free end and the third guide band positioned closer to the fixing location, wherein the second connector of the waist buckle is threaded through only the first guide band and connected to the first connector in a small waist arrangement of the waist band, wherein the second connector of the waist buckle is threaded through the third and the first guide bands and connected to the first connector in a mid-sized waist arrangement of the waist band, and wherein the second connector of the waist buckle is threaded through the third, second, and first guide bands and connected to the first connector in a large waist arrangement of the waist band.

* * * * *